United States Patent [19]

Fletcher et al.

[11] 3,971,230

[45] July 27, 1976

[54] STIRLING CYCLE ENGINE AND REFRIGERATION SYSTEMS

[76] Inventors: James C. Fletcher, Administrator of the National Aeronautics and Space Administration, with respect to an invention of; Walter H. Higa, Tujunga, Calif.

[22] Filed: May 5, 1975

[21] Appl. No.: 574,208

[52] U.S. Cl. ..... 62/6

[51] Int. Cl.[2] ..... F25B 9/00

[58] Field of Search ..... 62/6

[56] References Cited

UNITED STATES PATENTS

| | | | |
|---|---|---|---|
| 2,750,765 | 6/1956 | Kohler et al. | 62/6 |
| 3,078,683 | 2/1963 | Dros | 62/6 |
| 3,101,596 | 8/1963 | Rinia et al. | 62/6 |
| 3,216,190 | 11/1965 | Baker | 62/6 |
| 3,292,501 | 12/1966 | Verbeck | 62/6 |
| 3,367,121 | 2/1968 | Webb | 62/6 |
| 3,550,371 | 12/1970 | Jaspers | 62/6 |
| 3,793,846 | 2/1974 | Dehne | 62/6 |

*Primary Examiner*—Lloyd L. King
*Attorney, Agent, or Firm*—Monte F. Mott; Wilfred Grifka; John R. Manning

[57] ABSTRACT

A Stirling cycle heat engine is disclosed in which displacer motion is controlled as a function of the working fluid pressure $P_1$ and a substantially constant pressure $P_0$. The heat engine includes an auxiliary chamber at the constant pressure $P_0$. An end surface of a displacer piston is disposed in the auxiliary chamber. During the compression portion of the engine cycle when $P_1$ rises above $P_0$ the displacer forces the working fluid to pass from the cold chamber to the hot chamber of the engine. During the expansion portion of the engine cycle the heated working fluid in the hot chamber does work by pushing down on the engine's drive piston. As the working fluid pressure $P_1$ drops below $P_0$ the displacer forces most of the working fluid in the hot chamber to pass through the regenerator to the cold chamber. The engine is easily combinable with a refrigeration section to provide a refrigeration system in which the engine's single drive piston serves both the engine and the refrigeration section.

12 Claims, 5 Drawing Figures

FIG. 1
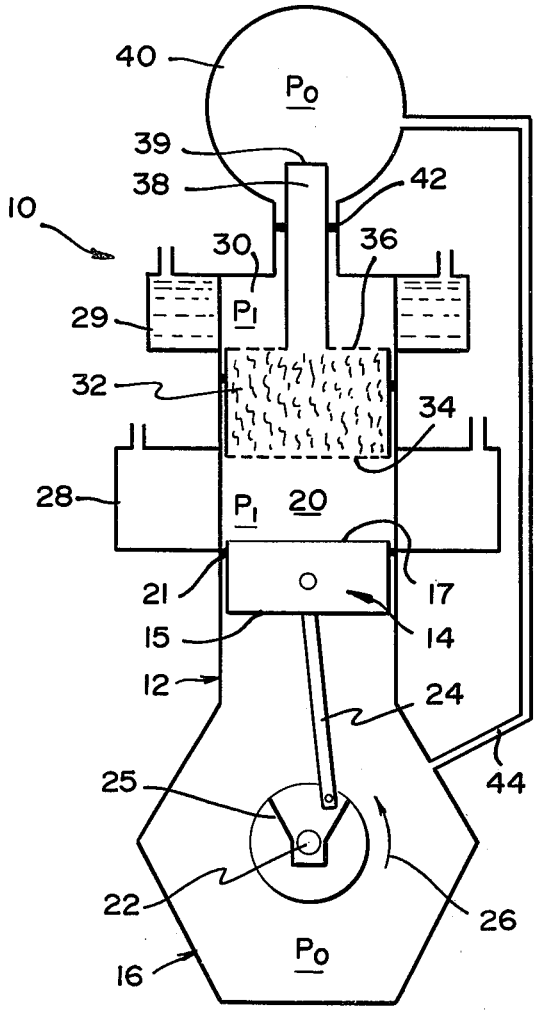
FIG. 3
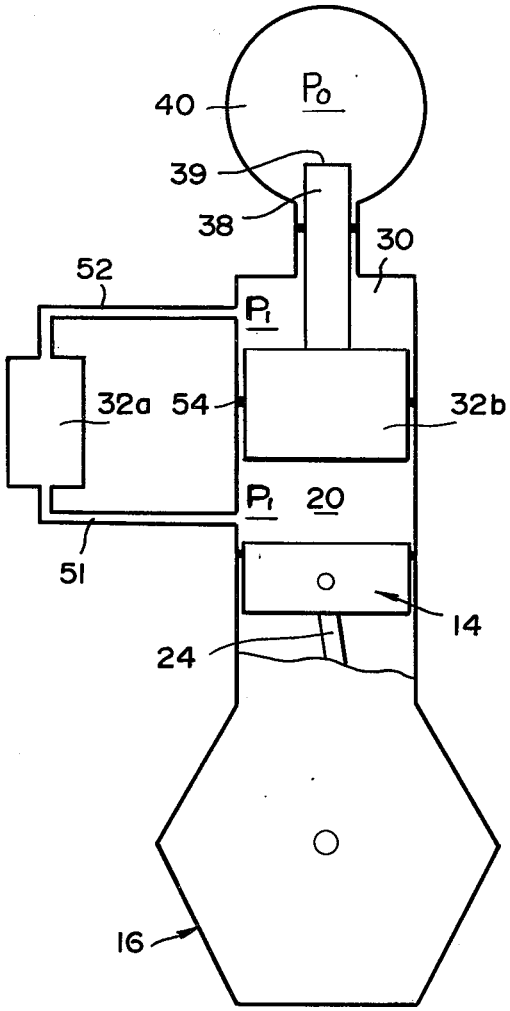
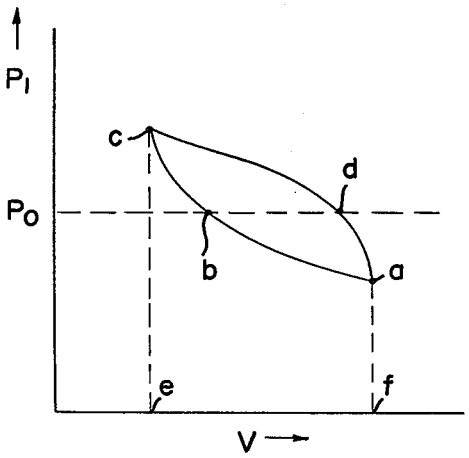
FIG. 2

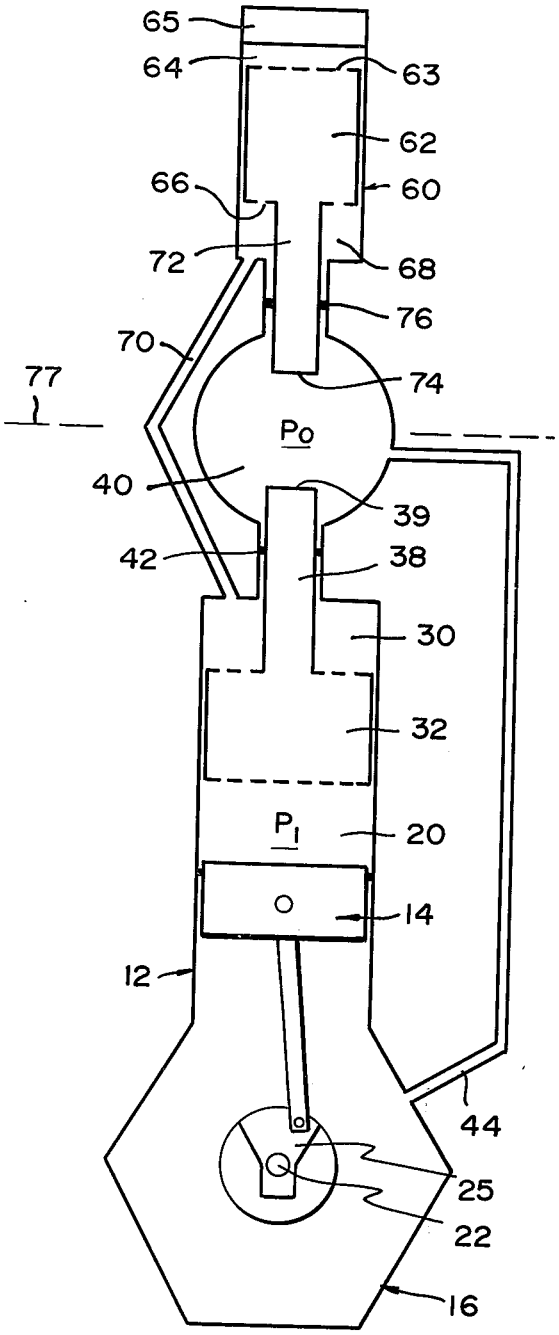
FIG. 4
FIG. 5
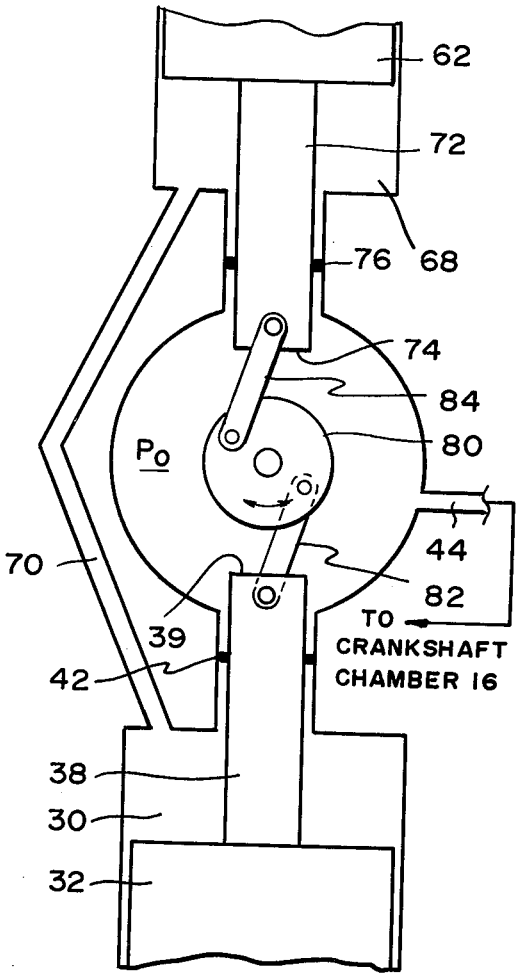

STIRLING CYCLE ENGINE AND REFRIGERATION SYSTEMS

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

1. Field of the Invention

The present invention generally relates to heat engines and, more particularly, to a simplified Stirling cycle type engine in which heat from an external source is converted to useful mechanical energy.

2. Description of the Prior Art

A Stirling cycle machine is a device which operates on a regenerative thermodynamic cycle, with cyclic compression and expansion of the working fluid at different temperature levels, and where the flow is controlled by volume changes, so that there is a net conversion of heat to work or vice versa. In a typical Stirling cycle engine, operating as a prime mover, heat is supplied to the working fluid at some high temperature $T_{max}$, when the fluid is in a hot chamber. Part of the heat is converted to work when the working fluid, due to the absorbed heat, expands and thereby pushes on a piston, which is coupled to a crankshaft and imparts rotary motion thereto. The working fluid is then displaced by a displacer through a regenerator and forced into a cold chamber, which is at some lower temperature, $T_{min}$. As the working fluid passes through the regenerator the latter absorbs some of the heat of the passing working fluid. The working fluid is then compressed and some of its heat is rejected and absorbed by air or water used to maintain the cold chamber at $T_{min}$. Thereafter, the working fluid is forced out of the cold chamber by the displacer through the regenerator into the hot chamber, and as it passes the regenerator it reabsorbs some of the heat previously deposited thereat. In the hot chamber it again absorbs heat and the cycle of operation repeats itself.

In the Stirling cycle engine operating as the prime mover, the working fluid expansion takes place in the hot chamber, while most of the compression takes place in the cold chamber. As is appreciated by those familiar with the art when the Stirling cycle is used in a refrigerating machine the working fluid expansion occurs in the cold chamber while the compression of the working fluid, during which heat is rejected, takes place in the hot chamber. In either type machine the working fluid is shifted between the two chambers through a regenerator by means of the displacer. The motion of the latter is generally synchronized with the piston motion by means of mechanical linkages which adds to the complexity of the machine.

OBJECTS AND SUMMARY OF THE INVENTION

It is a primary object of the present invention to provide a new heat engine.

Another object of the present invention is to provide a simplified Stirling cycle engine capable of producing work from heat derived from an external source, the engine being characterized by the absence of mechanical linkages between the engine displacer and the power piston.

A further object of the present invention is to provide a new refrigeration system utilizing heat from an external source.

These and other objects of the invention are achieved by providing an engine in which the motion of the displacer is a function of a substantially constant pressure, defined as $P_0$ and the working fluid pressure $P_1$. The engine includes an auxiliary chamber into which extends the end surface of a piston connected to the displacer. The pressure in the auxiliary chamber as well as in the crankshaft casing or chamber, which is in communication with the auxiliary chamber, is $P_0$, which for all practical purposes is constant. The working fluid pressure is $P_1$.

During the compression portion of the cycle when $P_1 > P_0$, the displacer moves in a direction so as to force the working fluid from the cold chamber into the hot chamber. On the other hand during the expansion portion of the cycle when the heated working fluid does work on the drive piston of the engine, pushing it in a direction so as to enable the working fluid to expand, at some point during expansion $P_1$ falls below $P_0$. Therefore, the displacer moves in a direction so as to force the working fluid out of the hot chamber into the cold chamber. The cold chamber of the Stirling cycle engine may be connected to a Stirling cycle refrigeration section, in a novel manner as will be described hereinafter, to produce a novel refrigeration system in which only a single drive piston is required.

The novel features of the invention are set forth with particularity in the appended claims. The invention will best be understood from the following description when read in conjunction with the accompanying drawings.

BRIEF DESCRIPTION OF THE DRAWINGS

FIG. 1 is a simplified view of the novel heat engine of the present invention;

FIG. 2 is a volume-pressure diagram of the thermodynamic cycle of the working fluid;

FIG. 3 is a partial view of the engine with the regenerator outside the engine housing;

FIG. 4 is a simplified view of a refrigeration system in accordance with the present invention; and FIG. 5 is a partial view of another embodiment of the refrigeration system.

DESCRIPTION OF THE PREFERRED EMBODIMENTS

Attention is directed to FIG. 1 wherein numeral 10 designates the heat engine with a multichamber engine housing 12. A drive piston 14 is mounted for reciprocal movement in housing 12. The bottom side 15 of the drive piston is exposed in a crankshaft chamber 16, which is connected to engine housing 12, while the top side or surface 17 of piston 14 is exposed in a hot chamber 20, in housing 12. A seal 21 around piston 14 separates chambers 16 and 20 from one another. The drive piston 14 is connected to the engine's crankshaft 22 by means of a connecting rod 24. A flywheel 25 is also connected to the crankshaft 22.

As will be explained hereinafter in detail a working fluid in chamber 20 applies a downward force on the drive piston 14 when the latter is in its most upward position, thereby imparting a rotary motion to the crankshaft, as represented by arrow 26. The working fluid may be air, $H_e$, $H_2$ or $N_2$. Surrounding hot chamber 20 is a heat transfer manifold 28 whose function is to supply heat to the working fluid which is present in chamber 20, while a cold transfer manifold 29 surrounds a cold chamber 30. The function of the manifold 29 is to cool working fluid, present in cold chamber 30 by removing heat from the working fluid. The cooling of the working fluid may be accomplished with cold air or water or any other appropriate means.

Also included in the engine housing 12 is a displacer/regenerator 32 having first and second end surfaces 34 and 36, which are respectively exposed in the hot chamber 20 and the cold chamber 30. Extending from surface 36 is a displacer piston 38 having a free end surface 39. A portion of piston 38 with the surface 39 extends into an auxiliary chamber 40. A seal 42 isolates cold chamber 30 from chamber 40. The auxiliary chamber 40 and the crankshaft chamber 16 are interconnected by a conduit 44, so that the pressure in the two chambers is the same, and is designated as $P_0$. The volumes of chambers of chambers 16 and 40 are relatively large so that despite the reciprocal motion of drive piston 14 in and out of chamber 16 and the reciprocal motion of displacer piston 38 in and out of chamber 40 for all practical purposes, the pressure $P_0$ is constant, and therefore hereinafter it will be referred to as the constant pressure $P_0$.

As is appreciated by those familiar with the art a regenerator may be thought of as a thermodynamic sponge, alternately releasing and absorbing heat as a working fluid passes therethrough in opposite directions, with very little restriction. The displacer/regenerator 32 may consist of a tube filled with steel wool, the latter serving as the regenerator. As will be explained hereinafter in detail, when the displacer/regenerator 32 moves down, working fluid passes from hot chamber 20 through the regenerator to cold chamber 30, and as it passes through the regenerator the latter absorbs heat from the working fluid. On the other hand, when the displacer/regenerator 32 moves up, working fluid flows from the cold chamber 30 through the regenerator to the hot chamber 20, and as it passes through the regenerator, it absorbs heat therefrom. As will be pointed out hereinafter, the regenerator portion of the displacer/regenerator 32, may be outside engine housing 12.

Ideally, the regenerator should have zero dead volume, so that it provides only a path for the working fluid with which it exchanges heat, but none of the fluid remains in the regenerator. In practice, however, a regenerator with zero dead volume is unattainable. However, regenerators with very small dead volumes can be achieved with compacted steel wool or other materials known by those familiar with the art. As shown in FIG. 1 the pressure in hot chamber 20 is designated $P_1$. Since the displacer/regenerator 32 is porous, as indicated by the dashed lines of surfaces 34 and 36, the working fluid is free to flow through the displacer/regenerator. Thus, the pressure in cold chamber 30 is the same as the pressure in hot chamber 20, namely $P_1$.

It should be apparent from FIG. 1 that when the pressure $P_1$ is greater than $P_0$ ($P_1 > P_0$), the displacer/regenerator moves up, thereby increasing the volume of chamber 20 and decreasing the volume of chamber 30. While the displacer/regenerator moves up working fluid in chamber 30 passes through the displacer/regenerator 32 from chamber 30 to chamber 20. On the other hand, when $P_0 > P_1$ the opposite takes place. That is, the displacer/regenerator 32 moves down, thereby decreasing the volume of chamber 20 and increasing the volume of cold chamber 30. During the downward motion working fluid passes through the displacer/regenerator from chamber 20 to chamber 30.

The operation of the heat engine 10 will be described now starting off with a point in the cycle of operation in which it is assumed that the drive piston 14 is in its most downward position and that $P_0 > P_1$. Therefore, the displacer/regenerator 32 is in its most downward position. The downward motion of the displacer/regenerator 32 is limited so that its bottom surface 34 never touches the top surface 17 of drive piston 14. When displacer/regenerator 32 is down, most of the working fluid is in the cold chamber 30. As the drive piston 14 starts to move up from its most downward position, it compresses the working fluid in the cold chamber 30, which is cooled by the cold transfer manifold 29.

As the drive piston 14 continues to move up, at some point, the working fluid pressure $P_1$ exceeds the constant pressure $P_0$. Consequently, the displacer/regenerator 32 moves up toward chamber 30.

As the displacer/regenerator moves up, practically reducing the volume of cold chamber 30 to zero, the working fluid, present in chamber 30, passes through the displacer/regenerator 32 to hot chamber 20. As it passes through displacer/regenerator 32 it absorbs some heat, previously deposited in the regenerator. As the working fluid enters working chamber 20 it is further heated by heat absorbed from the heat transfer manifold 28, surrounding chamber 20. At the same time the drive piston continues to move up to its most upward position due to flywheel inertia. In this position the total volumes of chambers 20 and 30 is a minimum. Moreover, the pressure $P_1$ is at a maximum, since the total volume of chambers 20 and 30 is a minimum, and due to the heat absorbed by the working fluid in chamber 20.

The working fluid, due to the increase in pressure $P_1$ to a maximum, has to expand. However, since the displacer/regenerator 32 is in its most upward position, the only direction in which the fluid can expand is against the top surface 17 of drive piston 14. The expanding working fluid therefore applies a downward force on the drive piston 14, which is in turn imparted as rotary motion to the crankshaft 22.

As the drive piston 14 is pushed down by the expanding working fluid the latter tends to cool, which together with the increase in volume of hot chamber 20, due to the downward motion of the drive piston results in a reduction of pressure chamber 20. In the engine of the present invention, the drive piston 14, due to the force applied to it by the expanding fluid and the flywheel inertia, moves down from its most upward position to its most downward position at a rate, so that at some point during the downward motion of the drive piston, the pressure $P_1$ drops below the constant pressure $P_0$, before sufficient heat is absorbed by the working fluid in chamber 20 so as to maintain the pressure $P_1$ above $P_0$ in spite of the increased volume of chamber 20 and the cooling of the working fluid due to its expansion. This can be achieved by controlling the amount of working fluid used, the temperature difference between the hot and cold chambers 20 and 30, the size of the flywheel, all of which control the rate of rotation of the crankshaft, and therefore the rate at which the drive piston moves between its most upward position to its most downward position.

When, during the downward motion of the drive piston 14 the pressure $P_1$ in chamber 20 drops below $P_0$, since surface 39 of displacer piston 38, which is attached to the displacer/regenerator 32, is subjected to the pressure $P_0$ in chamber 40, the displacer/regenerator 32 is pushed down. As it moves down, the expanded hot working fluid in hot chamber 20 passes through the porous displacer/regenerator 32 to cold chamber 30 whose volume increases as the displacer/regenerator 32 moves down. As the hot working fluid passes through the downward-moving displacer/regenerator 32, the regenerator absorbs some of the heat of the working fluid which passes through it.

It should be pointed out that since the downward motion of the displacer/regenerator 32 is limited, so as not to come in contact with the top surface 17 of drive piston 14, when the displacer/regenerator 32 moves down, most but not all of the working fluid passes to the cold chamber 30. However, for explanatory purposes, it will be assumed that all the working fluid is in chamber 30 when the displacer/regenerator is down. This completes the engine's cycle of operation, which is repeated, when, due to the flywheel inertia the drive piston 14 starts to move up again, as hereinbefore described.

FIG. 2 to which reference is made is a pressure-volume diagram of the working fluid for the thermodynamic cycle of the engine. At point "*a*" the drive piston 14 is in its most downward position, the displacer/regenerator 32 is down, and the working fluid is in the cold chamber 30 where it is cooled. Thus, the pressure $P_1$ is at a minimum and the total volume, occupied by the working fluid in chambers 20 and 30, is at a maximum. Now, as the drive piston 14 starts to move up due to the flywheel inertia, the volume decreases and the pressure increases, until the working fluid pressure $P_1 = P_0$, represented by point *b*.

As the drive piston continues to move up and the volume decreases, $P_1$ becomes greater than $P_0$. Therefore, the displacer/regenerator 32 moves up. As it moves up the working fluid passes through the displacer/regenerator from cold chamber 30 to the hot chamber 20, absorbing heat from the regenerator, as it passes through it. Between points *b* and *c* the displacer/regenerator 32 has reached its most upward position. In this position the volume of cold chamber 30 may be assumed to be zero and further assuming for explanatory purposes that the regenerator has zero dead volume, effectively all the working fluid is in the hot chamber 20. The drive piston 14 continues to move to its most upward position, thereby further decreasing the working fluid volume.

Point *c* represents the maximum level of pressure $P_1$ of the working fluid and the minimum volume of the working fluid in hot chamber 20. This occurs when the drive piston 14 is in its most upward position. As the working fluid absorbs heat from manifold 20 it has to expand. Since the displacer/regenerator 32 is in its mot upward position in which the volume of chamber 30 is assumed to be zero, it cannot be pushed up. Thus, the only way for the working fluid to expand is by pushing drive piston 14 down, thereby reducing the pressure and increasing the volume, as represented by the line between points *c* and *d*. The pressure reduction is due to the increased volume, as the drive piston 14 moves down, as well as due to the fact that the working fluid cools as it expands.

As previously indicated, the downward motion of the drive piston, due to the downward force applied to it by the hot expanding working fluid and the flywheel inertia, is such that the pressure $P_1$ in hot chamber 20 reaches the constant pressure $P_O$, as represented by point *d*, and thereafter falls below $P_O$ before sufficient heat is absorbed from manifold 28 by the working fluid in the hot chamber so as to maintain the pressure $P_1$ in the hot chamber above $P_O$, in spite of the working fluid expansion and the increased chamber volume. As the pressure $P_1$ drops below $P_O$ the displacer/regenerator 32 moves down. As the drive piston 14 moves downwardly, the volume increases and the pressure decreases until point "*a*" is reached, which is assumed to occur when the drive piston is in its most downward position. In this position the total working fluid volume in chambers 20 and 30 is a maximum, while the working fluid pressure $P_1$ is a minimum. Typically, $P_1$ is greater than $P_O$ during one half cycle and is lower than $P_O$ during the other half cycle.

In FIG. 2, the work done by the working fluid in pushing down on the drive piston 14 is given by the area enclosed inside the trajectory *abcda*. The heat which is supplied by the external heat source through manifold 28 is given by the area *cdafec*, and the heat absorbed by the cooling manifold 29 is given by the area *afecba*.

Although the efficiency of the engine is not particularly high it is useful wherever large quantities of heat are available, and unless utilized to produce useful energy will be completely wasted. For example, the novel heat engine of the present invention may be used to convert heat from a nuclear reactor to mechanical energy to drive, by means of crankshaft 22, an electrical generator in a power plant. It should be appreciated that the heat engine of the present invention is simpler than other known heat engines. The engine, described herein, does not require any mechanical linkages to synchronize the displacer motion with the drive piston motion.

In the engine of the present invention displacer motion is controlled by the pressure difference between the constant pressure $P_O$ and the working fluid pressure $P_1$. In the present invention auxiliary chamber 40, into which displacer piston 38 extends, is provided. It is connected via conduit 44 with the crankshaft chamber 16 and the pressure $P_O$ in both these chambers is substantially constant. Whenever the working fluid pressure $P_1$ is greater than $P_O$ the displacer/regenerator moves up, and when $P_1$ is less than $P_O$ the displacer/regenerator moves down.

It should be appreciated that although in FIG. 1 the regenerator is included in the displacer/regenerator 32 inside the engine housing 12, as previously pointed out, if desired, the regenerator may be placed outside the housing, and a solid cylinder may be used as the displacer in the housing 12. Such an arrangement is shown in FIG. 3, wherein the regenerator is designated by 32*a* and shown connected to the hot and cold chambers 20 and 30 by conduits 51 and 52 respectively. In FIG. 3 the displacer is designated by 32*b* and a seal 54 is shown separating chambers 20 and 30 from one another in order to force any working fluid transfer between these chambers to take place only through the regenerator 32*a*.

From the foregoing, it should be appreciated that the engine, hereinbefore described, is a Stirling cycle type engine. In it, working fluid is transferred between hot and cold chambers, which for explanatory purposes are assumed to be maintained at temperatures $T_h$ and $T_c$ where $T_h >> T_c$. Heat at temperature $T_h$ is supplied to the working fluid by manifold 28 when the working fluid is in the hot chamber 20. Part of this heat is converted to work, represented by the expanding heated working fluid pushing down the drive piston 14. Part of the absorbed heat is rejected, as heat, at the lower temperature $T_c$ when the working fluid is in the cold chamber 30 and is cooled by air or water circulating through manifold 29.

As in the case of the efficiency of the Carnot cycle, the efficiency of the engine can be improved by increasing $T_h$ and decreasing $T_c$. Generally, the difference between $T_h$ and $T_c$ is on the order of a few hundred degrees F. For example, $T_h$ may be on the order of 800°–1000°F and $T_c$ on the order of about 200°F. Thus, the terms hot and cold, as hereinafter used to describe chambers 20 and 30 are relative terms, intended to indicate that chamber 20 is at a higher temperature than chamber 30.

The engine of the present invention is suited for constant speed operation as in an electrical power plant. It is not suited for high speed operation, nor variable speed operation. It should be appreciated that for efficiency reasons, the constant pressure $P_O$ has to be quite high on the order of a few hundred, e.g., 200 psi or more, which the chambers 16 and 40 have to withstand. This requirement dictates a heavier engine housing as compared with that of an internal combustion engine.

The novel heat engine may be combined with a refrigeration section to achieve a thermally driven refrigeration system in which the single drive piston 14 is used for both the engine and the refrigeration section. This aspect may best be explained in conjunction with FIG. 4. As shown, the refrigeration section comprises a housing 60 in which a displacer/regenerator 62 is enclosed. Housing 60 extends from the auxiliary chamber 40, the top surface 63 of displacer/regenerator 62 is exposed in a refrigeration chamber 64, while the bottom surface 66 of displacer/regenerator 62 is exposed in a cold chamber 68, which is in communication with the cold chamber 30 of the engine by means of conduit 70. Extending from surface 66 into chamber 40 is a piston 72 with an exposed end surface 74. A seal 76 separates chamber 68 from chamber 40. In FIG. 4, the elements shown above dashed line 77 are part of the refrigeration section while those below line 77 are part of the engine section of the refrigeration system. To simplify FIG. 4, the manifolds 28 and 29 are not shown.

In practice chamber 30 and 68 are at the same temperature $T_c$, controlled by manifold 29, while the temperature of the refrigeration chamber, designated $T_r$ is less than the temperature $T_c$ of chamber 68. Generally, in a refrigeration system the temperature $T_c$ of the chambers 30 and 68 is ambient or room temperature.

It should be appreciated that all four chambers 20, 30, 68 and 64 are at the same pressure $P_1$, since chambers 20 and 30 are in communication through the porous displacer/regenerator 32, chambers 30 and 68 are in communication through conduit 70 and chambers 68 and 64 are in communication through porous displacer/regenerator 62. And, since the end surface 74 of piston 72 is exposed to the constant pressure $P_O$ in chamber 40 the motion of the displacer/regenerator 62, like that of displacer/regenerator 32 of the engine, is a function of the pressures $P_O$ and $P_1$. When $P_1$ is less than $P_O$ the displacer/regenerator 62 is set up, thereby reducing the volume of the refrigeration chamber 64 to zero or a minimum. On the other hand, when $P_1$ is greater than $P_O$ the displacer/regenerator 62 is down, and therefore the volume of chamber 68 is a minimum and the volume of chamber 64 is a maximum.

In operation, when the drive piston 14 is down and $P_O > P_1$ the displacer/regenerators 32 and 62 are down and up, respectively. As the drive piston 14 moves up, due to the inertia of flywheel 25, working fluid compression takes place, and when $P_1$ becomes greater than $P_O$ displacer/regenerators 32 and 62 move up and down, respectively. In the engine section of the system as displacer/regenerator 32 moves up the working fluid passes from cold chamber 30 to hot chamber 20, while in the refrigeration section of the system, as displacer/regenerator 62 moves down, the working fluid in cold chamber 68 passes through displacer/regenerator 62 to the colder refrigeration chamber 64. As it passes through displacer/regenerator 62 the working fluid deposits heat in the regenerator.

As previously explained, when the drive piston 14 starts to move down after reaching its most upward position and the pressure $P_1$ drops, the heated working fluid in chamber 20 expands and thereby cools. In the refrigeration system, since prior to the drop in the pressure $P_1$, most if not all of the working fluid is in the refrigeration chamber 64, when the pressure $P_1$ drops from its maximum level, the working fluid in chamber 64 expands and thereby cools. The cooling of the working fluid in chamber 64 provides the desired refrigeration for any element such as element 65 which is attached to housing 60 at the refrigeration chamber 64. As is appreciated the refrigeration of element 65 is achieved by the expanding and cooling fluid absorbing heat therefrom so as to maintain it at the desired temperature, hereinbefore referred to as $T_r$.

It should be noted that in the engine section expansion occurs in the hot end, i.e., in the hot chamber 20, which is at the higher temperature than chamber 30. However, in the refrigeration section the expansion occurs in the cold end, i.e., in the refrigeration chamber 64, which is at the lower temperature than chamber 68. It should be appreciated that in the system, shown in FIG. 4, the single drive piston 14 is used for both the engine and the refrigeration sections. It is of course appreciated by those familiar with the art that proper sizing of the two sections relative to each other is required to achieve optimum efficiency. A sufficiently heavy flywheel 25 should be used to obtain smooth and constant speed operation.

Since the motions of the two displacer/regenerators 32 and 62 are 180° apart it may be desirable to add an idler 80, as shown in FIG. 5, inside auxiliary chamber 40 and two connecting rods 82 and 84, respectively connected to displacer pistons 38 and 72 of the two displacer/regenerators, to assure synchronism as well as to provide limit stops for their motions. Indeed, even in the embodiment in which the engine 10 is used to drive an external load, other than the refrigeration section the idler 80 and connecting rod 82 may be used to control the motion of displacer/regenerator 32, particularly its downward motion to insure that the bottom surface 34 of displacer/regenerator 32 does not touch the drive piston 14, when the former moves down, which takes place when pressure $P_O$ exceeds pressure $P_1$.

In FIG. 4 the regenerator portion of displacer/regenerator 62 is shown inside housing 60. It should however be appreciated that if desired the regenerator portion may be outside the housing 60, as previously explained in connection with displacer/regenerator 14 and FIG. 3.

It should be pointed out that when ample thermal energy is available for transfer to the working fluid through manifold 28, the engine section may be used to drive the refrigeration section, while at the same time mechanical power may be extracted from crankshaft 22 to drive an external load, e.g., a power generator. If, however, the available thermal energy is limited the engine may be used to either drive the external load or the refrigeraton section. If thermal energy is lacking mechanical power may be injected by rotating crankshaft 22 to perform the refrigeration process in hereinbefore described. Free piston devices do not have this advantage.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. In a Stirling cycle engine of the type including first and second variable volume chambers, a working fluid, heating means for supplying heat at a temperature $T_h$ to working fluid in said first chamber, cooling means for absorbing heat at a temperature $T_c$ from working fluid in said second chamber, $T_h >> T_c$, the working fluid being at a variable pressure definable as $P_1$, a drive piston having a top surface exposed to said first chamber, a displacer mounted for reciprocal motion between said first and second chambers to alternately vary the volumes thereof, a regenerator in communication with said first and second chambers for providing a communication path for the working fluid between said chambers, and drive means coupled to said drive piston for moving said drive piston from a first position in which the total volume of said first and second chambers is a maximum and the working fluid pressure $P_1$ is at a minimum level, to a second position in which the total volumes of said first and second chambers is a minimum and the working fluid pressure $P_1$ is at maximum level, the improvement comprising:

a displacer piston coupled to said displacer and defining an end surface remote therefrom;

a third chamber, said displacer piston end surface being disposed therein, and the pressure in said third chamber being substantially constant and definable as $P_O$, $P_O$ being between the maximum and minimum levels of $P_1$, whereby as said drive piston moves from said first position toward said second position, when $P_1$ is greater than $P_O$ said displacer moves in a direction to minimize the volume of said second chamber and thereby force working fluid contained therein to pass through said regenerator to said first chamber, and drive piston being movable by said drive means and working fluid present in said first chamber and heated by said heating means, from said second position to said first position, whereby as said working fluid pressure $P_1$ drops below $P_O$, and displacer moves in a direction to decrease the volume of said first chamber and increase the volume of said second chamber.

2. In a Stirling engine cycle as described in claim 1 wherein said drive means and said drive piston are exposed in a fourth chamber, conduit means for connecting said third and fourth chambers, with the pressure in both said third and fourth chambers being substantially constant at $P_O$, and seal means surrounding said drive piston for isolating said first chamber from said fourth chamber.

3. In a Stirling engine cycle as described in claim 1 wherein said drive means comprises a rotatable crankshaft, a flywheel coupled to said crankshaft for rotation therewith, and a connecting rod connecting said drive piston to said crankshaft, whereby during a first half of each cycle of rotation of said crankshaft said drive piston moves from said first position to said second position due to flywheel inertia, and when said drive piston is at substantially said second position the working fluid in said first chamber, due to heat absorbed from said heating means, push on said drive piston with a force which together with said flywheel inertia move said drive piston from said second position to said first position thereby imparting a rotary motion to said crankshaft during the second half of each cycle of rotations, said drive piston moving from said second position to said first position at a rate whereby the working fluid pressure $P_1$ drops below the substantially constant pressure $P_O$, when the drive piston is between said second and first positions thereof, with said displacer moving in a direction to maximize the volume of said second chamber with working fluid in said first chamber passing through said regenerator from said first chamber to said second chamber.

4. In a Stirling engine cycle as described in claim 3 wherein said regenerator moves together with said displacer in a direction to minimize the volume of said second chamber when $P_1$ is greater than $P_O$, and moves together with said displacer in an opposite direction to maximize the volume of said second chamber when $P_O$ is greater than $P_1$.

5. In a Stirling engine cycle as described in claim 3 wherein said drive means and said drive piston are exposed in a fourth chamber, conduit means for connecting said third and fourth chamber, with the pressure in both said third and fourth chambers being substantially constant at $P_O$, and seal means surrounding said drive piston for isolating said first chamber from said fourth chamber.

6. In a Stirling engine cycle as described in claim 5 wherein said regenerator moves together with said displacer in a direction to minimize the volume of said second chamber when $P_1$ is greater than $P_O$, and moves together with said displacer in an opposite direction to maximize the volume of said second chamber when $P_O$ is greater than $P_1$.

7. A Stirling cycle system comprising:

first and second variable volume chambers;

a working fluid;

heating means for supplying heat at a temperature $T_h$ to working fluid present in said first chamber;

cooling means for absorbing heat at a temperature $T_c$ from working fluid present in said second chamber, $T_h >> T_c$;

a first displacer mounted for reciprocal motion between said first and second chambers to alternately vary the volumes thereof;

a first regenerator in communication with said first and second chambers for providing a communication path for working fluid passing between said first and second chambers, the working fluid being at a variable pressure definable as $P_1$;

a first displacer piston coupled to said first displacer and defining an end surface remote therefrom;

an auxiliary chamber at a substantially constant pressure definable as $P_O$ said end surface of said first displacer piston being exposed in said auxiliary chamber, $P_O$ being between the maximum and minimum levels of $P_1$;

a drive piston having a top surface exposed in said first chamber; and drive means including means for coupling said drive piston to said drive means, for moving said drive piston from a first position in which the total volumes of said first and second chambers is a maximum and the working fluid pressure $P_1$ is at a minimum level below $P_O$ to a second position in which the total volume of said first and second chambers is a minimum and the pressure $P_1$ of said working fluid is at a maximum level above $P_O$, said first displacer moving in a direction to minimize the volume of said second chamber and force the working fluid to pass through said first regenerator to said first chamber when $P_1$ exceeds $P_O$, the working fluid in said first chamber being heated by said heating means thereby applying a force to said drive piston in a direction to drive said drive piston from said second position toward said first position thereby increasing the total volume of said first and second chamber with said working fluid expanding in said first chamber and the pressure thereof being reduced from said maximum level as said drive piston moves from said second position to said first position, said drive means including flywheel means for driving said piston to said first position at a rate whereby said working fluid pressure $P_1$ drops below $P_0$ when said drive piston moves from said second to said first position, said first displacer moving in a direction to maximize the volume of said second chamber and force working fluid through said first regenerator from said first chamber to said second chamber when $P_1$ exceeds $P_0$.

8. In a Stirling cycle system as described in claim 7 wherein said drive means includes a rotatable crankshaft, which rotates one half of a revolution as said drive piston moves from said first position to said second position, and another half of a revolution when said drive piston moves from said second to said first position.

9. In a Stirling cycle system as described in claim 8 wherein said drive means are enclosed in a crankshaft chamber which is at said substantially constant pressure $P_0$ and seal means surrounding said drive piston to isolate said first chamber from said crankshaft chamber.

10. In a Stirling cycle system as described in claim 7 further including third and fourth variable volume chambers, conduit means for providing a path for working fluid between said second and third chambers, said cooling means absorbing heat from working fluid in said third chamber at said $T_c$ temperature;

means in communication with said fourth chamber for supplying heat thereto at a refrigeration temperature $T_r$, where $T_r < T_c$;

a second displacer mounted for reciprocal motion between said third and fourth chambers to alternately vary the volumes thereof;

a second regenerator in communication with said third and fourth chambers for providing a path for working fluid therebetween; and a second displacer piston coupled to said second displacer and defining an end surface remote therefrom and exposed in said auxiliary chamber at said substantially constant pressure $P_0$, whereby as said fluid pressure $P_1$ is less than $P_0$, said second displacer moves in a direction to maximize the volume of said fourth chamber and force fluid to pass through said second regenerator from said third chamber to said fourth chamber and when said fluid pressure drops from its maximum level working fluid in said fourth chamber expands and cools, with the working fluid therein being forced out of said fourth chamber into said third chamber through said second regenerator by said second displacer when $P_0$ is greater than $P_1$.

11. In a Stirling cycle system as described in claim 10 wherein said drive means are enclosed in a crankshaft chamber, means for providing a communication path between said auxiliary chamber and said crankshaft chamber with the pressure in both chambers being at the substantially constant pressure $P_0$ and seal means surrounding said drive piston to isolate said first chamber from said crankshaft chamber.

12. In a Stirling cycle system as described in claim 11 wherein said drive means includes a rotatable crankshaft, which rotates one half of a revolution as said drive piston moves from said first position to said second position, and another half of a revolution when said drive piston moves from said second to said first position.

* * * * *